United States Patent [19]

Teubler

[11] Patent Number: 4,770,612

[45] Date of Patent: Sep. 13, 1988

[54] STEERING POWER-ASSISTANCE ARRANGEMENT

[75] Inventor: Heinz Teubler, Friedrichsdorf, Fed. Rep. of Germany

[73] Assignee: Vickers Systems GmbH, Bad Homburg, Fed. Rep. of Germany

[21] Appl. No.: 69,652

[22] Filed: Jul. 6, 1987

[30] Foreign Application Priority Data

Jul. 11, 1986 [DE] Fed. Rep. of Germany ..... 3623421

[51] Int. Cl.[4] ..... F04B 49/00; F01C 21/00

[52] U.S. Cl. ..... 417/300; 418/178; 418/133

[58] Field of Search ..... 417/300; 418/178, 149, 418/133

[56] References Cited

U.S. PATENT DOCUMENTS

| | | | |
|---|---|---|---|
| 3,523,746 | 8/1970 | Dadian | 417/178 |
| 3,695,791 | 10/1972 | Brundage | 418/133 |
| 3,752,609 | 8/1973 | Niemiec | 418/133 |
| 3,964,844 | 6/1976 | Whitmore | 417/133 |
| 4,008,002 | 2/1977 | Niemiec | 418/133 |
| 4,072,451 | 2/1978 | Niemiec | 418/178 |
| 4,470,768 | 9/1984 | Konz | 418/133 |
| 4,558,998 | 12/1985 | Kiyoshige | 418/178 |
| 4,637,782 | 1/1987 | Teubler | 417/300 |
| 4,681,517 | 7/1987 | Schulz | 417/300 |

FOREIGN PATENT DOCUMENTS

| | | | |
|---|---|---|---|
| 169916 | 2/1986 | European Pat. Off. | 417/300 |
| 199833 | 11/1986 | European Pat. Off. . | |
| 3237380 | 4/1983 | Fed. Rep. of Germany | 417/299 |
| 53690 | 3/1983 | Japan | 418/149 |

*Primary Examiner*—William L. Freeh

*Attorney, Agent, or Firm*—Barnes, Kisselle, Raisch, Choate, Whittemore & Hulbert

[57] ABSTRACT

A steering power-assistance pump of vane type includes a combined flow control and pressure relief valve. When the steering valve of the steering arrangement shuts off the flow of oil, the output of the pump is converted into heat within the pump which accordingly suffers a substantial rise in temperature. The rotor of the pump and the cam ring with which the rotor vanes co-operate are combined with a pressure plate and a wear plate on respective sides of the rotor to form a unit which is displaceable in the axial direction of the pump against the force of a compressible sealing means for sealing off inlet ducts relative to a pressure chamber behind the pressure plate. The unit is thus displaced against the force of the compressible sealing means, as a result of thermally induced deformation of the housing portions of the pump. The wear and pressure plates have coatings of bearing metal on their surfaces which co-operate with the rotor, to provide better anti-friction properties.

9 Claims, 3 Drawing Sheets

STEERING POWER-ASSISTANCE ARRANGEMENT

TECHNICAL FIELD

The present invention relates generally to a steering power-assistance arrangement and is more particularly concerned with the steering power-assistance pump thereof.

BACKGROUND OF THE INVENTION

A steering power-assistance arrangement generally includes an assistance pump which is usually in the form of a vane-type pump, as can be seen from European Pat. No. 68 035. In the installed condition of the pump, it is connected to a hydraulic steering arrangement which includes a steering valve, the position of which depends on the position of the steering wheel which forms part of the steering system of the motor vehicle whose steering is to be power-assisted. The steering valve is supplied with a controlled working or output flow which is controlled by a flow control valve arranged in the pump housing. In order to provide a compact construction, a pressure relief valve for limiting the pressure in the system, in the form of a pilot control valve, is combined with the flow control valve as the main valve component, whereby the relieved flow of hydraulic fluid is returned into the feed system of the pump, over a short distance.

Now, when parking a motor vehicle with such a power assistance arrangement, it may happen that the steering system is moved into one of its limit positions, in other words the steering wheel of the vehicle is turned until it reaches a limit position in which it is prevented from further rotation in that direction, whereby the controlled output flow is shut off. As a result of that, the pressure in the steering assistance arrangement rises substantially so that the pressure relief valve then responds. In such a situation, a large amount of power is converted at the combined valve arrangement, and that gives rise to a corresponding increase in the temperature of the hydraulic oil in the system. Where, in such circumstances, the hydraulic fluid is circulated within the pump between the feed system and the discharge system of the arrangement, the hydraulic fluid does not experience any cooling effect by flowing through the other hydraulic lines between the pump and the steering assembly of the vehicle, so that the hydraulic oil temperature in the pump can reach a level of more than around 250° C., within a few seconds. If the power-assistance pump is designed with a housing of aluminium or an aluminium alloy, in order to provide a saving in weight, the substantial thermal expansion of the material of the housing of the pump gives rise to adverse affects in respect thereof; for example where the pump is a vane-type pump comprising a housing made up of a main housing portion and a flange-like cover portion which is fitted on to the main housing portion, then thermal expansion of the housing structure can result in the middle part of the cover portion of the housing deflecting towards the rotor which is rotatable within the housing, so that the cover portion rubs against the rotor and can ultimately cause it to jam, with the result that the drive shaft of the system is damaged or possibly broken.

In one form of vane-type pump for power steering systems, as disclosed in European Pat. No. 14 836, the pump comprises a housing formed by a cup-shaped housing portion and a bowl-like cover portion which together define the internal chamber of the pump. Disposed in the internal chamber of the pump is an insert assembly comprising a pressure plate, a wear plate, a cam ring and a rotor, with a spring being provided to hold the components of the insert assembly together. In a practical case (Vickers VT 50-pump) the above-mentioned pressure plate is 13 mm in thickness while the highest pressure involved in the pump is around 100 bars. The side plates comprising the above-mentioned pressure plate and wear plate are made of sintered steel and do not have any coating of bearing metal thereon, so that the rotor, as it rotates, bears directly against the pressure plate and the wear plate. That system includes a combined flow control and pressure relief valve which extends parallel to the axis of the machine and which, in the event of the pressure relief function becoming operative, gives rise to a short-circuit between the outlet ports and the inlet ports of each displacement region of the pump, thus resulting in a substantial increase in temperature. Thermal expansion which may occur can be readily accommodated by the insert assembly being displaced against the force of the above-mentioned spring which holds the components thereof in the assembled condition. The inlet ports of that system are arranged between the cam ring and the pressure plate of the pump, in other words, apertures in the pressure plate serve only as outlet ports. There is therefore no need for the inlet ports to be sealed off in the region behind the pressure plate.

Another vane-type pump, as disclosed in German Patent specification No. 2 735 663, comprises a housing formed by an annular housing portion and a cover portion which co-operate to define the internal chamber of the pump. Side plates which are provided with bearing metal on the operative surfaces thereof are clamped between the housing portion and the cover portion, and enclose the rotatable rotor with its vanes. The above-mentioned side plates comprise steel and, in the layer of bearing metal applied thereto, have harder portions of an island-like configuration, with which the plates are supported against the parts of the housing. The side plates are immovable in the axial direction of the machine, in contrast to the pressure plate which, when the pump is in the form of a steering power-assistance pump (as in European Pat. No. 14 836), has a certain amount of axial displaceability within the housing of the pump, in order thereby to be urged towards the rotor by the pressure generated within the pump. In addition, the system disclosed in German Pat. No. 2 735 663 does not have a combined flow control and pressure relief valve within the housing, so that hydraulic fluid under high pressure is not relieved into the feed or intake system within the pump, over a short flow distance. That arrangement therefore does not involve the risk of the pump rapidly overheating when the pressure relief function comes into operation, because the system is protected by a pressure relief valve which is disposed at a more remote position. The remote positioning of the pressure relief valve therefore affords a possibility of the hydraulic oil being cooled as it flows through conduits in the system. In existing pumps of that kind, for example the VQ-pumps from Vickers Inc., Troy, United States of America, the housing comprises cast iron so that the problems of excessive thermal expansion do not arise.

A further example of side plates which are clamped in position in the pump housing, with bearing metal on the operative surfaces thereof, is to be found in European Pat. No. 68 354 B1. That arrangement also does not have a combined flow control and pressure relief valve within the housing of the pump, and the pump cannot be used for steering power assistance purposes.

SUMMARY OF THE INVENTION

An object of the present invention is to provide a steering power-assistance arrangement which is more reliable in operation than previous systems, even under adverse operating conditions thereof.

Another object of the present invention is to provide a steering power-assistance arrangement with a power-assistance pump so designed as to be able to withstand short-term overheating in a more acceptable fashion.

Still another object of the present invention is to provide a steering power-assistance hydraulic pump which can operate at pressures of up to around 100 to 170 bars without suffering from serious adverse effects due to overheating in certain operating phases of the pump.

In accordance with the present invention, these and other objects are achieved by a steering power-assistance arrangement including a power-assistance pump such as a vane-type pump having a main housing portion and a flange-like cover portion of aluminium or aluminium alloy, which is fitted on the main housing portion. Disposed within the housing is a driven rotor which is provided with a plurality of pump vanes and which, with fixed parts of the pump, including a pressure plate and a cam ring which is co-operable with the vanes as the rotor rotates, forms at least one displacement region communicating with inlet port means and outlet port means. The pressure plate which is disposed at one side of the rotor has at least one through opening therein, which is sealed off relative to high pressure at the back of the pressure plate, by sealing means extending around the through opening in the pressure plate. The inlet port means of the or each displacement region communicate with a feed or delivery system while the outlet ports communicate with a discharge system. The discharge system and the feed system communicate with each other by way of a combined flow control and pressure relief valve which includes a movable spool having a first higher-pressure spool surface and a second lower-pressure spool surface, a valve spring engaging the spool, and a restrictor throttle means. The valve, acting as a flow control valve, relieves an excess delivery flow into a relief pressure and into the feed system, and it outputs a controlled working or output flow to an outer pump outlet or service port. The combined flow control and pressure relief valve includes a pilot control stage which is responsive when a limit pressure is exceeded and displaces the spool into a position for communicating the discharge or outlet system with the feed or inlet system. The outer pump outlet or service port communicates with a hydraulic steering assembly which, when the steering is turned into a limit position, can move into a position in which the flow of hydraulic oil is almost completely blocked. The pressure plate within the pump and a wear plate which is disposed within the internal chamber of the pump on the opposite side of the rotor to the pressure plate are arranged around the cam ring and the rotor to form an axially displaceable unit which is pressed against the flange-like cover portion of the housing, by virtue of the sealing means disposed around the through openings in the pressure plate, which form part of the inlet port means of the pump. The pressure plate and the wear plate have layers of bearing metal on the surfaces thereof which are towards the rotor. The above-mentioned seals around the inlet port means bridge over a gap which is at least around 20 to 100 μm in width, between the pressure plate and the adjacent part of the main housing portion of the pump.

As will be seen in greater detail in connection with a preferred embodiment to be described hereinafter, when the pressure relief valve of the pump in accordance with the present invention responds and overheating of the interior of the pump occurs, that may admittedly result in deformation of the housing of the pump and thus give rise to considerable pressure as between the side plates, namely the pressure plate and the wear plate, and the rotor of the pump, which can result in those components running dry with evident disadvantageous consequences, but such pressures can be tolerated for a short period of time of for example around a minute, without the pump failing as a result.

In accordance with a feature of the invention, the above-mentioned sealing means for sealing off the inlet port means of the pump can compress and expand in the axial direction of the pump without losing their sealing action. In that way the insert assembly in the pump, consisting of the rotor and the side plates on respective sides thereof, together with the cam ring co-operating with the rotor vanes, can be displaced relative to the housing of the pump by the extent of the compressibility and expandability of the sealing means, if the pump involves an overheating situation resulting in the cover portion of the housing of the pump assuming a curved configuration. In that way the pressures which occur can be reduced, thus also decreasing the risk of the pump seizing.

Further objects, features and advantages of the present invention will become more clearly apparent from the following description of a preferred embodiment with reference to the accompanying drawings.

DESCRIPTION OF THE PREFERRED EMBODIMENT

Figure 3:
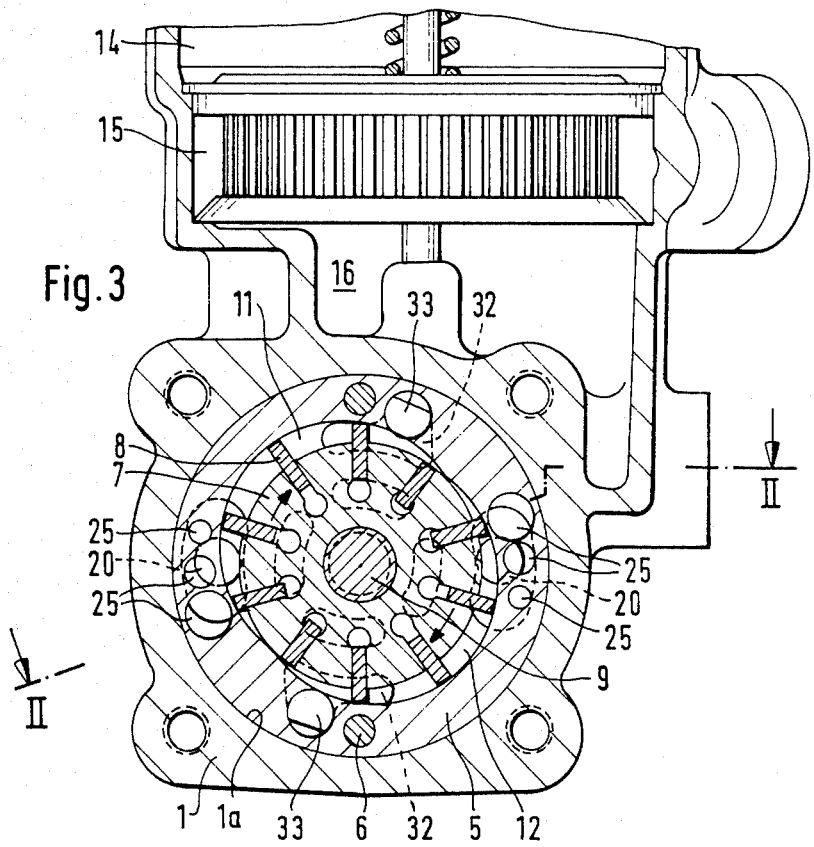
FIG. 3 is a view of the pump shown in FIG. 1 in vertical cross-section taken along line III—III in FIG. 1, but with a tank shown as being cast thereon.

Referring generally to the drawings, shown therein is a steering power-assistance pump adapted to form part of a steering power-assistance arrangement as for example for a motor vehicle. The pump illustrated is in the form of a vane pump and includes a housing comprising a main housing portion 1 and a cover portion 2 which is of a flange-like configuration, that is to say it is generally flat as opposed to being of a bowl-like or cup-like configuration. The portions 1 and 2 both comprise aluminium, which includes a suitable alloy thereof, and they co-operate in sealing relationship to define an internal pump chamber as indicated at 1a in FIGS. 1 and 3. Disposed in the chamber 1a is a wear plate 3 and a pressure plate 4 which are arranged on respective sides of a rotor 7, thus acting as side plates in relation thereto, as well as a cam ring 5 which is connected to the housing and cover portions 1 and 2 in such a way as to be non-rotatable therein, by means of pins 6. Arranged within the cam ring 5 and between the plates 3 and 4 is the rotatable rotor 7 which, as shown in FIG. 3, has a series of radial guide slots in spaced relationship around the rotor. Vanes 8 are radially slidably mounted within the guide slots and the radially outward end edges thereof co-operate slidably with the inside surface of the cam ring 5. The plates 3, 4, the cam ring 5 and the rotor 7 with its vanes 8 form a unit which is axially displaceable along the pins 6 by a certain distance of at least 20 to 100 μm.

The rotor 7 can be driven by way of a shaft 9 which is suitably mounted in a mounting bore in the cover portion 2 of the housing. The rotor 7 is of a cylindrical configuration while the cam ring 5 is of an approximately oval internal peripheral shape, with the short axis thereof approximately corresponding to the diameter of the rotor while the long axis of the oval configuration determines the distance by which the vanes 8 can move radially outwardly of the rotor. In that way, two generally sickle-shaped displacement regions 11 and 12 are provided between the cam ring 5 and the rotor 7, being subdivided by the vanes 8 into a plurality of spaces. The spaces defined between the vanes 8 increase in size at the suction or intake side of the system, and decrease in size at the pressure or outlet side, when the rotor 7 rotates.

Hydraulic fluid is supplied from a tank 14, as shown in FIG. 3, by way of a filter 15. The fluid passes into a distributor region 16 and then by way of two substantially perpendicular bores **17*a* and 17*b* which are indicated more particularly in FIG. 1, and curved supply or inlet ducts 18*a* and 18*b* which can be seen from FIG. 2, into through-flow openings 20 in the pressure plate 4. From there, the hydraulic fluid flows by way of inlets 25, 26, 27 and 28 respectively into the respective displacement regions of the pump. However the curved ducts 18*a* and 18*b* have a radially extending portion which communicates with a relief duct 19*a* and 19*b* respectively and is closed relative to the exterior by a respective plug 62**.

The through openings 20 in the pressure plate 3 are sealed by seals 21 in the form of O-rings, which extend around the respective openings 20. The O-rings 21 may have a support ring in order to increase the axial clearance between the rear surface of the pressure plate 4 and adjacent parts of the housing portion 1, as indicated at s in FIGS. 1 and 2, from the above-mentioned minimum amount of from 20 to 100 μm, to about for example 0.3 mm. Further sealing means 22 are provided to seal the gap between the housing portions 1 and 2.

Figure 1:
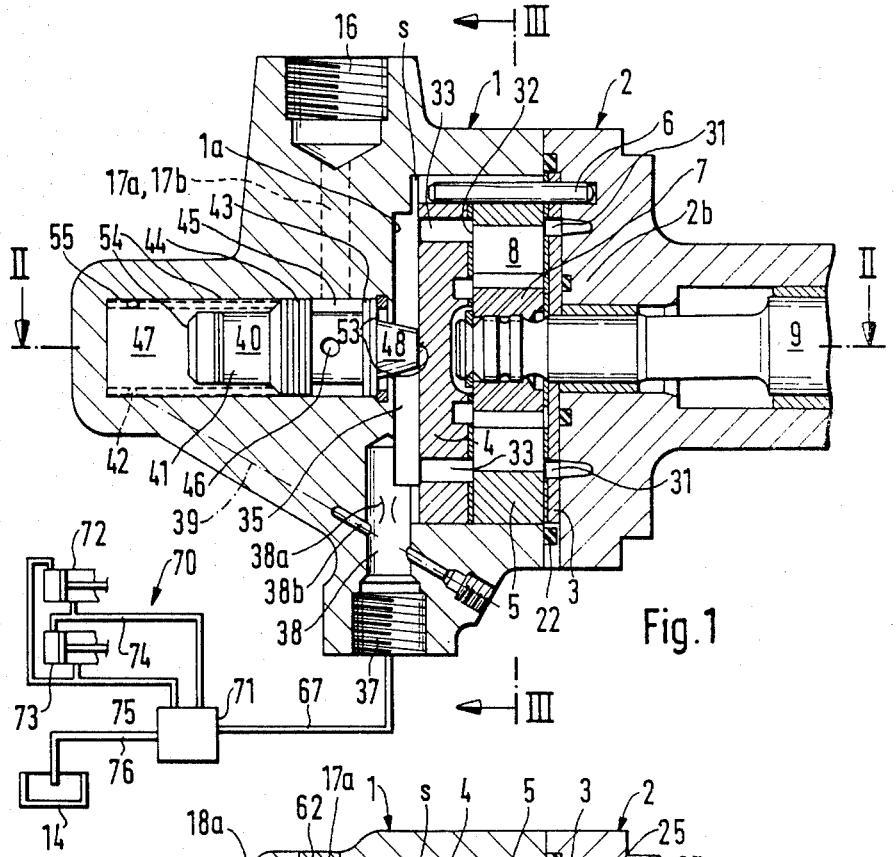
FIG. 1 is a view of a steering power-assistance pump in vertical longitudinal section taken along line I—I in FIG. 2.
Figure 2:
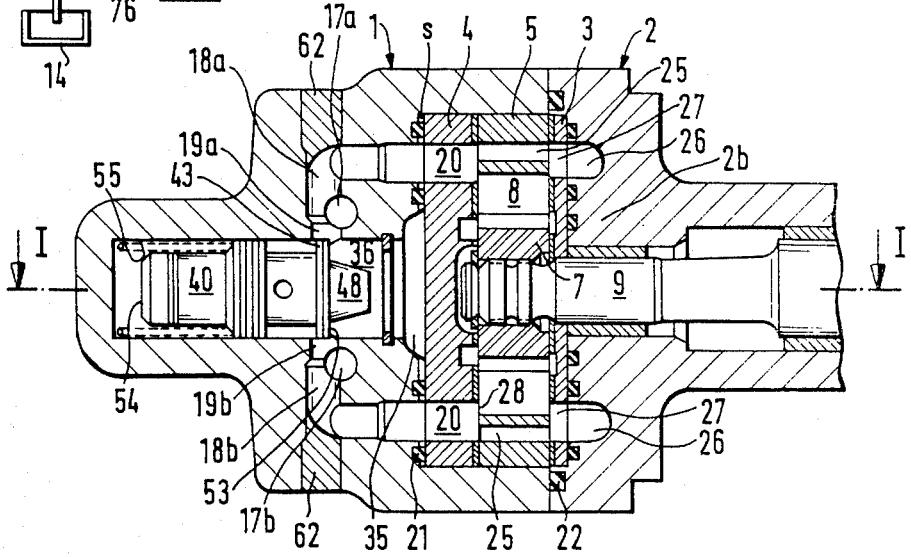
FIG. 2 is a view of the FIG. 1 pump in horizontal longitudinal section taken along line II—II in FIGS. 1 and 3.

On both sides of the vanes 8, arcuate grooves 31 and 32 are provided in the pressure and wear plates 3 and 4, as can be seen from FIG. 1 and FIGS. 5 through 8. The grooves 31 can be continued in the cover portion 2 of the housing. Discharge of the hydraulic fluid is by way of the grooves 31 and 32 and outlet ports 33, as indicated in FIG. 1, through the pressure plate 4 to the rear thereof and thus into a pressure chamber as indicated at 35 in FIG. 2, which communicates with a distribution chamber 36. The pump arrangement includes a combined flow control and pressure relief valve as indicated generally at 40 in for example FIGS. 1 and 2, which is operable to divide the pump delivery flow into a controlled working or output flow to the outer pump outlet or service port 37, which is shown in FIG. 1, and an excess by-pass flow which passes into the relief ducts **19*a* and 19*b*, as shown in FIG. 2. The controlled working or output flow passes through a restrictor throttle means or orifice 38*a* of a throttle member 38 to the outlet or service port 37. The pressure thereof communicates by way of a damping throttle means 38*b* and a duct diagrammatically indicated at 39 in FIG. 1, with the control chamber 47 of the valve 40**.

The valve 40 is disposed in a valve bore 55 whose end adjacent the above-mentioned pressure chamber 35 can accommodate a venturi nozzle as a distribution chamber 36, as described in European specification No. 151 657 A1. The throttle means **38*a* is then in the form of a transverse bore of the venturi nozzle arrangement. Alternatively, the inner end 48 of the valve 40** can be hollow as described in European specification No. 85 105 181.3, now European Pat. No. 19 9833.

Figure 4:
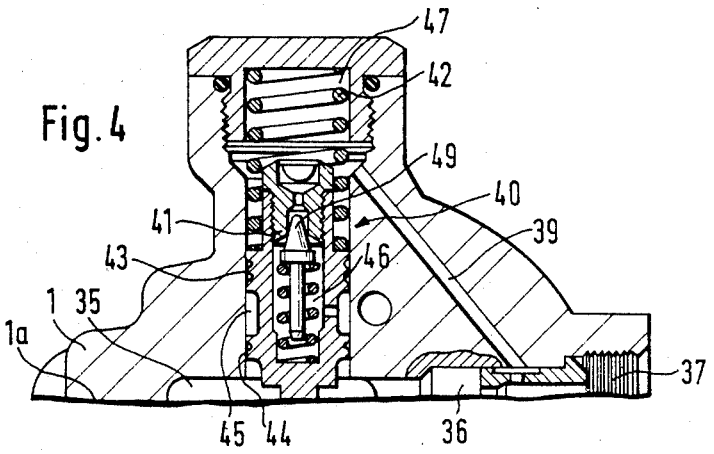
FIG. 4 shows a modified form of a detail from the FIG. 1 construction.

The combined valve 40 comprises a spool 41, which is shown in greater detail in FIG. 4. The spool 41 is urged towards the pressure chamber 35 by the force of a compression coil spring 42 and is possibly moved into a position of abutment therein. The spool 41 has spool surfaces 53 and 54 which respectively face towards the chambers 35 and 47 and which are subjected to the effect of pressure fluid acting thereon, as well as two shoulder-like sealing or land regions 43 and 44, with an annular groove 45 disposed therebetween.

When the valve 40 is closed, the relief ducts **19*a* and 19*b* communicates with the annular groove 45, as shown for example in FIG. 1. When fluid is taken off at the service port 37, a pressure difference occurs at the throttle means 38a and thus also at the spool surfaces 53 and 54 so that the spool 41 of the valve 40 is displaced in such a way that a part of the pump hydraulic fluid flows away by way of the relief ducts 19*a* and 19*b* (the system then operates as a flow control valve). It should be noted that the land 43 is narrower than the diameter or corresponding transverse dimension of the relief ducts 19*a* and 19*b* so that they remain in communication with the annular groove 45**.

From the annular groove 45, a duct 46 which extends partly radially and partly axially goes through the spool 41 into the control chamber 47, with the duct 46 being governed by a tapering or conical valve member 49 as shown in FIG. 4. When a given admissible pressure in the control chamber 47 is exceeded, the valve member 49 responds and relieves the pressure in the chamber 47 so that the spool 41 opens the way to the relief ducts **19*a* and 19*b***, so that the system operates as a pilot-controlled pressure relief valve.

The service port 37 communicates by way of a pump conduit 67 shown in FIG. 1 with a hydraulic steering arrangement 70 comprising a steering valve 71 and steering cylinder units 72 and 73. The steering cylinder units 72 and 73 communicate by way of respective working conduits 74 and 75 with the steering valve 71 which in turn has a tank conduit 76 leading to the tank 14. The steering valve 71 controls the flow of hydraulic fluid into the conduits 74 and 75 respectively and thus controls the flow to the corresponding sides of the steering cylinder units 72 and 73 which are here shown as being double-acting cylinder units, and through the respective return conduits to the tank 14. If the piston of one of the steering cylinder units 72 or 73 is in a position of abutment so that it can no longer move any further in the respective direction, no further hydraulic fluid can flow thereto so that the pressure in the conduit 67 rises abruptly, with a consequential rise in pressure in the valve control chamber 47. The pressure relief valve 49 responds and the spool 41 takes up a position as shown for example in FIG. 2. The entire delivery flow of hydraulic fluid flows directly into the relief ducts 19*a* and 19*b*, so that the pressure abruptly decreases. The power produced by the pump in that situation is converted into heat within the pump housing so that the hydraulic fluid is heated to a temperature of 250° C. and above within a few seconds, and correspondingly increases the temperature of the housing formed by the portions 1 and 2.

Between the grooves 26 and 31, the cover portion 2 has a region which is identified by reference 2*b* in FIGS. 1 and 2 and which, due to the thermal expansion effect, due to the increase in temperature of the housing, becomes curved towards the wear plate 3 and presses it against the rotor 7. The unit consisting of the two plates 3 and 4, the cam ring 5 and the rotor 7 is axially displaced along the mounting pins 6 thereof, but at the same time the plates 3 and 4 are pressed more firmly against the rotor 7, that is to say the clearance between the plates 3 and 4 and the adjacent side surfaces of the rotor 7 is practically totally eliminated. The force which resists such displacement of the above-indicated unit is produced by the hydraulic pressure in the pressure chamber 35 and the return force of the seals 21 which tend to be compressed by such axial movement of the unit. The pressure produced by the seals 21 depends on the extent to which they are compressed, that is to say, the inwardly directed curvature of the region 2*b* of the cover portion 3, as a result of thermal expansion. If the pump is operated with a higher pressure, for example 100 to 170 bars, than was hitherto the usual practice (around a value of 100 bars), then the expectation is that a greater amount of heat will be developed and thus also the seals 21 will be compressed to a greater degree, so that the pressure of the pressure plate 4 against the rotor 7 also correspondingly rises. At high pressures of that order of magnitude, the oil film between the rotor and the side plates 3 and 4 could be squeezed out so that in parts of the co-operating components, they could run dry.

Figure 5:
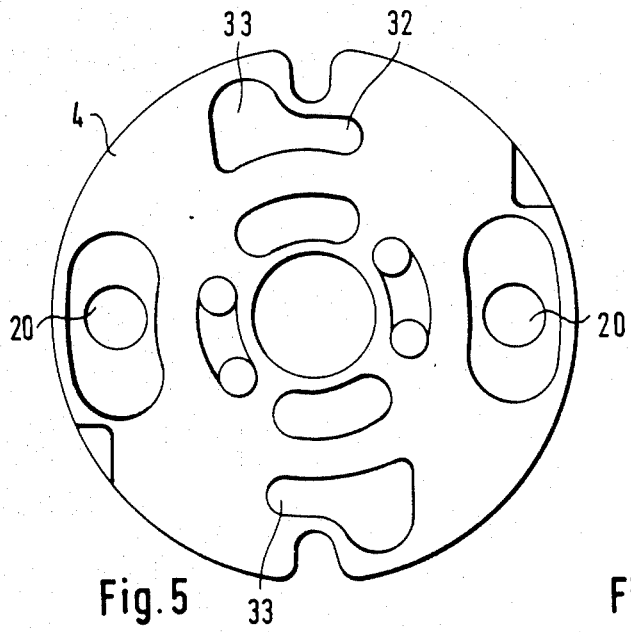
FIGS. 5 through 8 are front views and sectional views of the pressure plate and the wear plate respectively.
Figure 6:
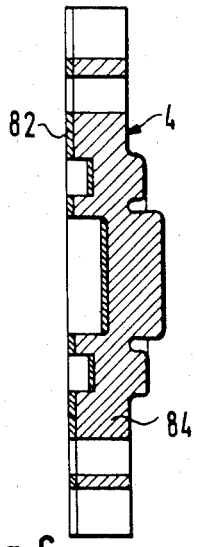
Figure 7:
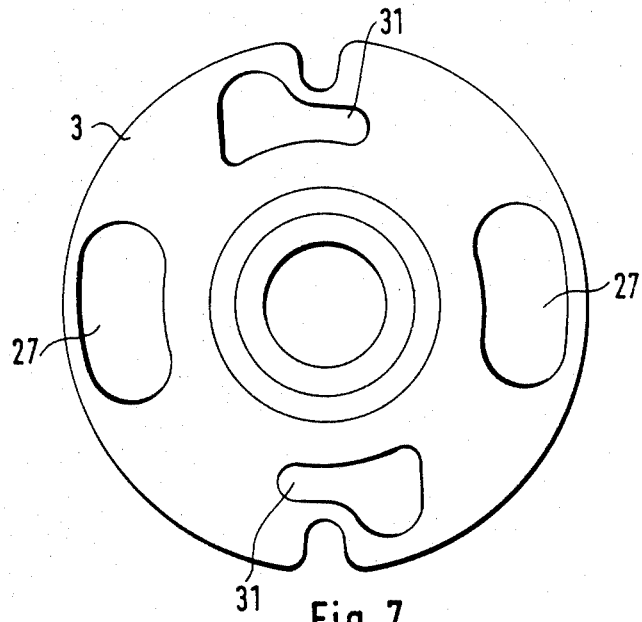
Figure 8:
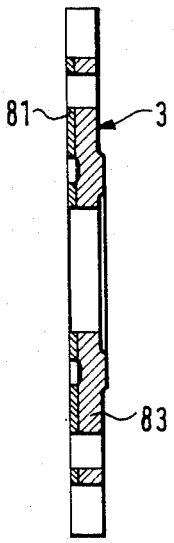

FIGS. 5 and 6 show the pressure plate 4 while FIGS. 7 and 8 show the wear plate 3. The plates 3 and 4 each have a layer as indicated at 82 and 81 respectively, of bearing metal. The main body portion 83 of the wear plate 3 is of a mean thickness of from 2 to 4 mm, preferably 3 mm, while the main body portion 84 of the pressure plate 4 is of a mean thickness of from 5 to 9 mm, preferably around 7 mm. The thickness of the layer of bearing metal in each case is around 0.5 mm. Bronze is preferred as the bearing metal, being rolled or sintered on to the backing material. Bronze of the composition 80 Cu, 10 Sn and 10 Pb has been found to be suitable for this purpose.

The pressure plate 4 is fairly stiff so that it bends or yields as little as possible and the clearance between the surface of the pressure plate and the rotor 7 is thus maintained for as long as possible.

The peripherally extending seals 21 comprise high-elasticity rubber which can withstand the changes in shape which occur when the pressure plate 4 is moved by small amounts, without suffering from damage in regard to the return force thereof.

It has surprisingly been found that the rotor in conjunction with the coated side plates 3 and 4 can run dry in the above-indicated manner for a short time without the assembly incurring damage. Experience has shown that, when a vehicle having the steering arrangement and the pump according to the invention is involved in parking manoeuvres, for moving into or moving out of a parking location, extreme deflection of the steering, that is to say, when the steering system is put into the 'full-lock' condition, with the engine running, does not last for more than about a minute. On that basis it is therefore possible to build a steering power-assistance pump for pressures of over 100 to 170 bars, in which the housing comprises aluminium material.

It will be appreciated that the above-described construction has been set forth solely by way of example of the principles of the present invention and that various modifications and alterations may be made therein without thereby departing from the spirit and scope of the invention.

What is claimed is:

1. In a steering power-assistance pump comprising: a main housing portion; a flange-like cover portion constructed and made of a material which will cause the cover portion to deflect at elevated temperatures co-operating with the main housing portion to provide an internal pump chamber; disposed in the pump chamber a drivable rotor provided with vanes and co-operating with fixed pump portions including a pressure plate and a cam ring around the rotor to define at least one displacement region; inlet port means communicating with said at least one displacement region and including at least one through opening in said pressure plate; sealing means at said at least one through opening in said pressure plate to seal same relative to high pressure at the side of the pressure plate opposite to said rotor, adjacent to a pressure chamber; outlet port means communicating with said at least one displacement region; a delivery system communicating with said inlet port means; a discharge system communicating with said outlet port means, a service outlet port adapted to supply fluid to a hydraulic fluid-operated steering arrangement which at extreme steering deflection can pass into an almost blocking position; a combined flow regulating and pressure relief valve means adapted to provide a communication between said delivery and discharge systems and including a spool having a first higher-pressure spool surface and a second lower-pressure spool surface in opposite relationship to said first spool surface, a valve spring and a throttle means, the valve means being operable as a flow control valve to relieve a controlled by-pass flow into the delivery system and being adapted to output a controlled output flow to said service outlet port, the valve further including a pilot control means adapted to respond when a limit hydraulic fluid pressure is exceeded and to actuate the spool into a position for communicating the discharge system with the delivery system, the improvement which provides that the pressure plate and a wear plate disposed on the side of the rotor in opposite relationship to the pressure plate, said cam ring, said wear plate and said cover portion each having at least an axially extending opening being registered with one another, pin means in said registered openings allowing said pressure plate, said cam ring and said wear plate to be axially displaced in said pump chamber as a unit and holding such unit against rotation; said unit being urged toward said cover portion by said sealing means, said pressure plate and said wear plate having coatings of bearing metal on the surfaces thereof which are towards said rotor, said pressure plate being positioned such that a gap of at least 20 to 100 μm in width is provided between said pressure plate and an adjoining part of said main housing portion, said seating means bridging said gap.

2. A pump as set forth in claim 1 wherein the thickness of the bearing metal layers is substantially 0.5 mm.

3. A pump as set forth in claim 1 wherein said bearing metal comprises bronze.

4. A pump as set forth in claim 1 wherein said housing portion and said cover portion comprise aluminium material.

5. A pump as set forth in claim 1 wherein said pressure plate is from 5 to 9 mm in thickness.

6. A pump as set forth in claim 5 wherein said thickness is substantially 7 mm.

7. A pump as set forth in claim 1 wherein said wear plate is from 2 to 4 mm in thickness.

8. A pump as set forth in claim 7 wherein said thickness is substantially 3 mm.

9. A steering power-assistance arrangement including a pump comprising: a main housing portion; a cover portion constructed and made of a material which will cause the cover portion to deflect at elevated temperatures co-operating with the main housing portion to provide an internal pump chamber; disposed in the pump chamber a rotor provided with vanes and co-operating with a pressure plate at one side of said rotor, a wear plate at the other side of said rotor, and a cam ring around the rotor, to define at least one displacement region, said pressure plate, said cam ring, said wear plate and said cover portion each having at least an axially extending opening, said openings being registered with one another; pin means in said registered openings allowing said pressure plate, said cam ring and said wear plate to be axially displaced in said pump chamber as a unit and holding such unit against rotation; said pressure plate and said wear plate having coatings of bearing metal on the surfaces thereof which are towards said rotor; means for driving said rotor in rotation; inlet port means communicating with said at least one displacement region and including at least one through opening in said pressure plate; sealing means at said at least one through opening in said pressure plate and disposed between said pressure plate and an adjoining part of said main housing portion to seal said through opening relative to high pressure at the side of the pressure plate opposite to said rotor, said pressure plate being positioned such that a gap of at least approximately 20 to 100 μm in width between said pressure plate and said adjoining part of said main housing portion and being operable resiliently to urge said axially displaceable unit towards said cover portion, said seating means bridging said gap; outlet port means communicating with said at least one displacement region; fluid delivery means communicating with said inlet port means; fluid discharge means communicating with said outlet port means and including a service outlet port adapted to supply output fluid from said pump; and a combined flow regulating and pressure relief valve means adapted to provide a communication between said fluid delivery and discharge means and including a spool having a first spool surface responsive to a high pressure in said pump and a second spool surface in opposite relationship to said first spool surface and responsive to a low pressure in said pump, a valve spring and a throttle means, the valve means being operable as a flow control valve to relieve a controlled by-pass flow into the delivery means and being adapted to output a controlled output flow to said service outlet port, the valve further including a pilot control means responsive when a limit hydraulic fluid pressure is exceeded to actuate the spool into a position for communicating the discharge means with the delivery means;

a source of hydraulic fluid connected to said delivery means; and a hydraulic fluid-operated steering assembly connected to receive said output fluid from said service outlet port to provide steering power assistance.

* * * * *